US007452222B2

(12) United States Patent
McIntire et al.

(10) Patent No.: US 7,452,222 B2
(45) Date of Patent: Nov. 18, 2008

(54) CABLE TERMINAL SEALING FACILITY

(75) Inventors: James Francis McIntire, West Linn, OR (US); Brian Erik Haug, Portland, OR (US)

(73) Assignee: Precision Interconnect, Inc., Wilsonville, OR (US)

( * ) Notice: Subject to any disclaimer, the term of this patent is extended or adjusted under 35 U.S.C. 154(b) by 0 days.

(21) Appl. No.: 10/574,431

(22) PCT Filed: Oct. 3, 2003

(86) PCT No.: PCT/US03/31541

§ 371 (c)(1),
(2), (4) Date: Jan. 22, 2007

(87) PCT Pub. No.: WO2005/043689

PCT Pub. Date: May 12, 2005

(65) Prior Publication Data

US 2007/0212924 A1 Sep. 13, 2007

(51) Int. Cl.
*H01R 13/44* (2006.01)

(52) U.S. Cl. ..... 439/142; 439/149; 439/521; 439/892; 439/909

(58) Field of Classification Search ..... 439/157, 439/909, 131, 135, 142, 149, 521, 892
See application file for complete search history.

(56) References Cited

U.S. PATENT DOCUMENTS 5,800,188 A * 9/1998 Barber et al. ..... 439/142

FOREIGN PATENT DOCUMENTS

| | | |
|---|---|---|
| DE | 4214031 A | 11/1993 |
| EP | 0401723 A | 12/1990 |
| EP | 0709924 A | 5/1996 |

* cited by examiner

*Primary Examiner*—Renee Luebke
*Assistant Examiner*—Vanessa Girardi

(57) ABSTRACT

A cap facility for a medical cable having a terminal defining a rimmed chamber containing electrical contacts. The facility has a frame that connects to the terminal. An arm is connected to the frame, and is movable between a first closed position and a second open position. The arm is biased to the closed position, and has a cap adapted to enclose the rimmed chamber when the arm is in the closed position. The cap has an arcuate motion path between the open position and an intermediate position proximate to the closed position, and an initial motion path deviating from the arcuate path, such that the cap moves away from the rim initially upon departing from the closed position. The facility may have a camming mechanism that provides the path.

12 Claims, 5 Drawing Sheets

CABLE TERMINAL SEALING FACILITY

FIELD OF THE INVENTION

This invention relates to facilities for sealing the terminals of cables, and more particularly to medical cables requiring sterilization.

BACKGROUND OF THE INVENTION

Medical instrumentation cables used in surgical or other critical environments require sterilization between uses. Such cables typically have a coating of plastic or other sterilizable material, with terminals having end recesses in which reside a number of pins, sockets, or other electrical contacts. Sterilization typically involves immersion of the entire cable assembly in a solution that is effective to sterilize surfaces it contacts. However, such sterilants (such as glutaraldehyde) are corrosive with respect to electronic elements, and may leave behind conductive residue that can generate electrical shorts between conductors of a cable terminal. The electrolytic effects that occur during subsequent use of the cable may accelerate corrosion. Further, to be effective against contaminants that may reside in cracks or recesses, sterilants have fluid characteristics that provide ready penetration, which further aggravates their adverse effects on the electronic components.

To avoid these effects, cable terminals are normally provided with caps that seal them against the sterilant, preventing the sterilant from reaching the electronic contacts. While effective when properly used, problems arise when the caps are not properly used. A common concern is that a user responsible for sterilization may not be aware of the need to cap the cable, or may wrongly assume that the interior of the cable terminal must be sterilized. In other instances, a cap tethered to a cable terminal may be cut off, so that future capping is not possible. Occasionally, even well-informed and well-trained personnel may forget to cap the cable terminals, or may cap them inadequately to prevent incursion of sterilants. Inadequate capping may occur with screw-on terminals that are inadequately seated.

When a pattern of uncapped sterilization occurs, a significant cable failure rate develops. Moreover, even when capping occurs properly, conventional caps require increased time for processing, marginally increasing medical labor costs. Accordingly, there is a need for a system that provides for cable sterilization without dependence on user knowledge or skill to protect cable portions that are sensitive to sterilants.

SUMMARY OF THE INVENTION

The present invention overcomes the limitations of the prior art by providing a cap facility for a medical cable having a terminal defining a rimmed chamber containing electrical contacts. The facility has a frame that connects to the terminal. An arm is connected to the frame, and is movable between a first closed position and a second open position. The arm is biased to the closed position, and has a cap adapted to enclose the rimmed chamber when the arm is in the closed position. The cap has an arcuate motion path between the open position and an intermediate position proximate to the closed position, and an initial motion path deviating from the arcuate path, such that the cap moves away from the rim initially upon departing from the closed position. The facility may have a camming mechanism that provides the path.

DETAILED DESCRIPTION OF A PREFERRED EMBODIMENT

Figure 1:
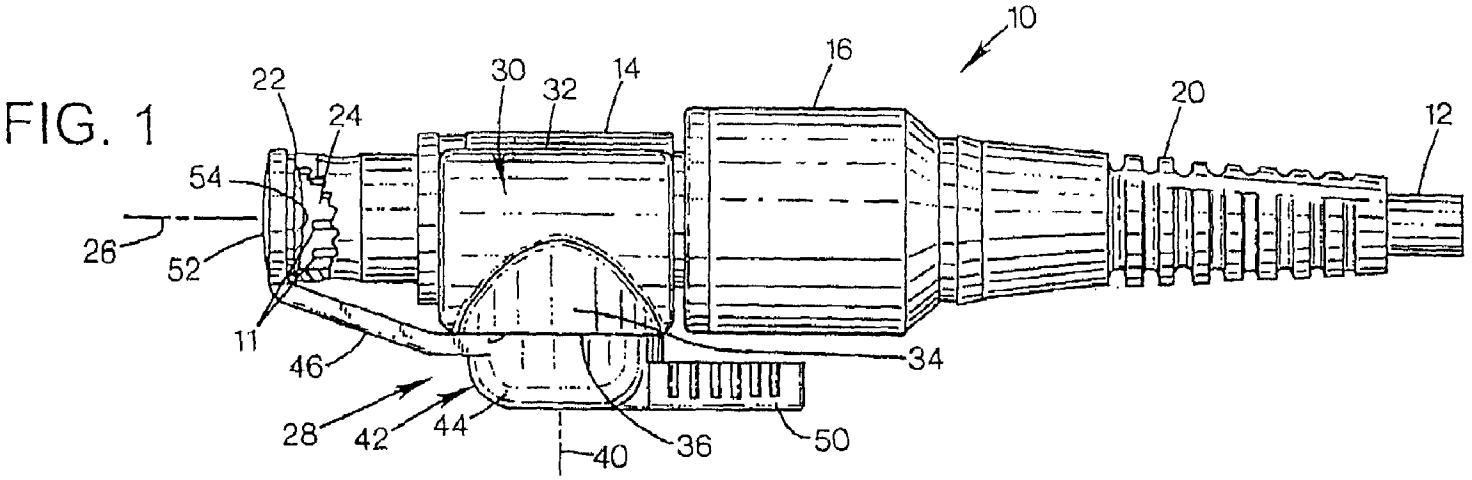
FIG. 1 is a top view of a cable terminal assembly according to a preferred embodiment of the invention.

FIG. 1 shows a cable terminal assembly 10 including a cable 12 having a terminal body 14 at a free end. A boot 16 and strain relief 20 (which may be an integrated unit) provide a transition to the terminal body, which is generally cylindrical, terminating at a free end circular rim 22. The terminal body defines a chamber 24 at the end, encompassed by the rim. One or more electrical contacts 11 reside in the chamber, and are electrically connected to wire conductors within the cable 12. The terminal body defines an axis 26.

A sealing mechanism 28 is connected to the terminal, and includes a frame 30 having a partial sleeve 32 that firmly and removably grips a cylindrical portion of the terminal body 14 at a position away from the rim 22. The frame has a boss portion 34 having a flat, circular face 36. A pivot axis 40 is central and perpendicular to the face, and intersects the terminal axis 26 at a right angle.

A pivot element 42 is pivotally connected to the frame for pivoting on the pivot axis between a closed position (shown) and an open position (to be discussed below). The pivot element includes a hub 44 centered on and overlaying the boss face 36, an arm 46 extending from the hub in a first direction toward the free end of the terminal (when in the illustrated closed position), and a handle 50 extending from the hub in a second direction approximately opposite the first direction.

The arm 46 is terminated in a circular cap portion 52 having a diameter slightly larger than the terminal rim 22, and overlaying the rim. The cap has a flexible elastomeric gasket 54 on the cap surface facing the pivot axis. The gasket is in the form of a dome, spherical section, or other suitable shape that provides a leak-proof-seal with the rim when the arm is in the closed position.

In the preferred embodiment, the frame 30 and pivot elements 42 are formed of a resilient thermoplastic resistant to the heat and chemicals used for sterilization, such as Radel R (Polyphenylsulfone). In one typical example, the terminal body 14 has a diameter of 0.627 inch, and the rim 22 has a diameter of 0.469 inch. The arm 46 may have an effective length between the pivot axis 40 and the cap 52 of 1.025 inch, and the gasket 54 may have a diameter of 0.525 inch. The gasket surface may have a radius of 0.875 inch, so that a line perpendicular to the surface of the gasket at the edge is offset by 76 degrees from the terminal axis 26. This will relate to the path the cap follows as the device is opened, as will be discussed below.

Figure 2:
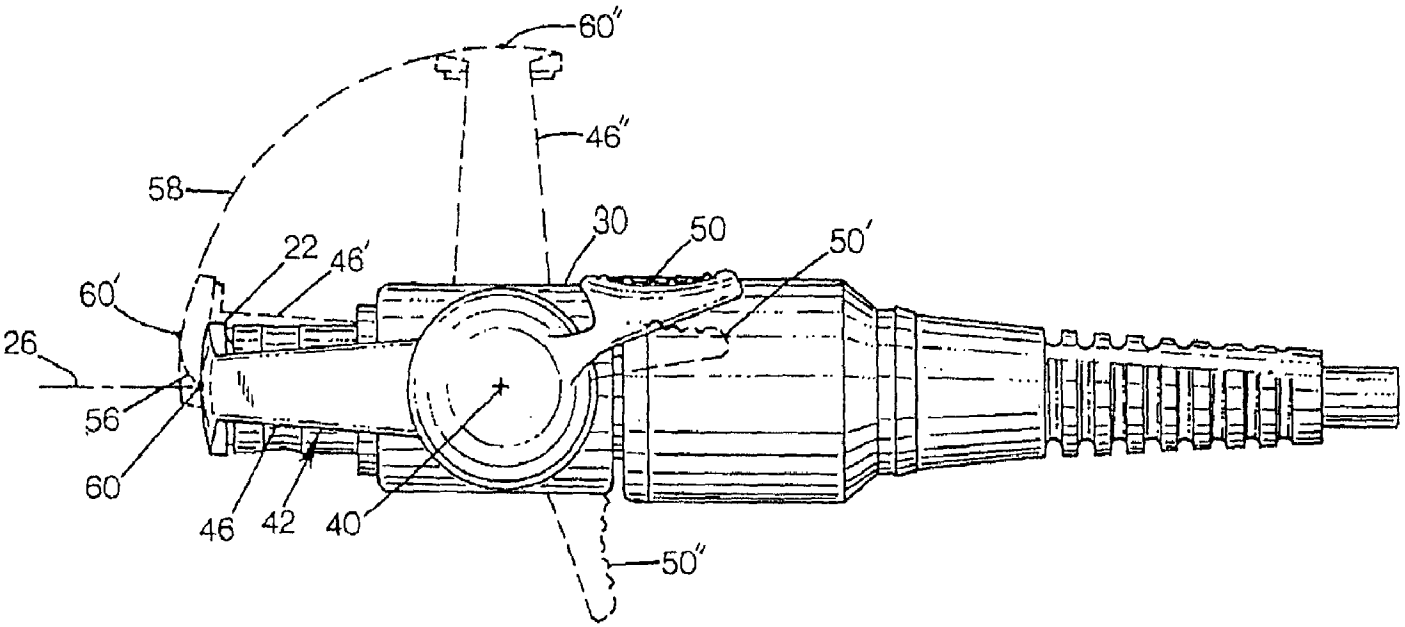
FIG. 2 is a side view of the assembly of FIG. 1.

FIG. 2 is a side view illustrating the overall operation of the pivot portion of the sealing mechanism. The arm 46 and handle 50 are shown in the closed position in solid lines. Also illustrated in dotted lines are an intermediate position of the arm 46' and handle 50' adjacent to the closed position, and a fully open position of the arm 46" and handle 50". The fully open position is about 90 degrees offset from the closed position, and the intermediate position is less than about 14 degrees from the closed position, although this may vary depending on the application and the needs of particular embodiments.

The pivot element is configured as will be discussed below to provide smooth operation that avoids the friction, wear, and damage that would lead to inadequate sealing if the pivot operation followed a simple arc centered on the pivot axis 40. The pivot axis is positioned in line with the connector axis 26 to provide accessibility of the actuator handle for ergonomic operation. The position also provides that the arm, when in the open position, is well rearward of the rim plane to avoid interference with an instrument to which the terminal is connected. However, a simple arc movement would cause the gasket to move laterally across the rim, without positive axial sealing force when in the closed position, and with the domed gasket resisting or preventing movement.

Accordingly, the preferred embodiment has a mechanism (to be discussed below) that provides a path of operation that provides positive capping force, and a lack of excessive operating friction. The cap follows a first path portion 56 between the closed position and the intermediate position, and a second path portion 58 between the intermediate position and the open position. To illustrate the paths, a selected point 60 at the center of the cap's outer surface is indicated (all points on the cap follow essentially similar paths.) The point is indicated as point 60' at the intermediate position, and as point 60" at the open position. The first path portion 56 extends at a significant angle away from the plane of the rim 22. The angle is established so that even the edge of the gasket recedes from the rim as the cap opens. The angle is at least greater than the angle of the gasket edge surface noted above, and is preferably at least 15 degrees. Thus, there is a significant axial component to the motion, and no rubbing of the gasket on the rim as the device is opened. In addition, with the pivot element biased to the closed position, the biasing force is essentially along the line of the path, so that there is a significant biasing force component in the axial direction to maintain a seal as needed for sterilization.

The second path portion 58 is essentially a simple circular arc centered on the axis 40. When the arm returns from the open position, it follows the same path.

Figure 4:
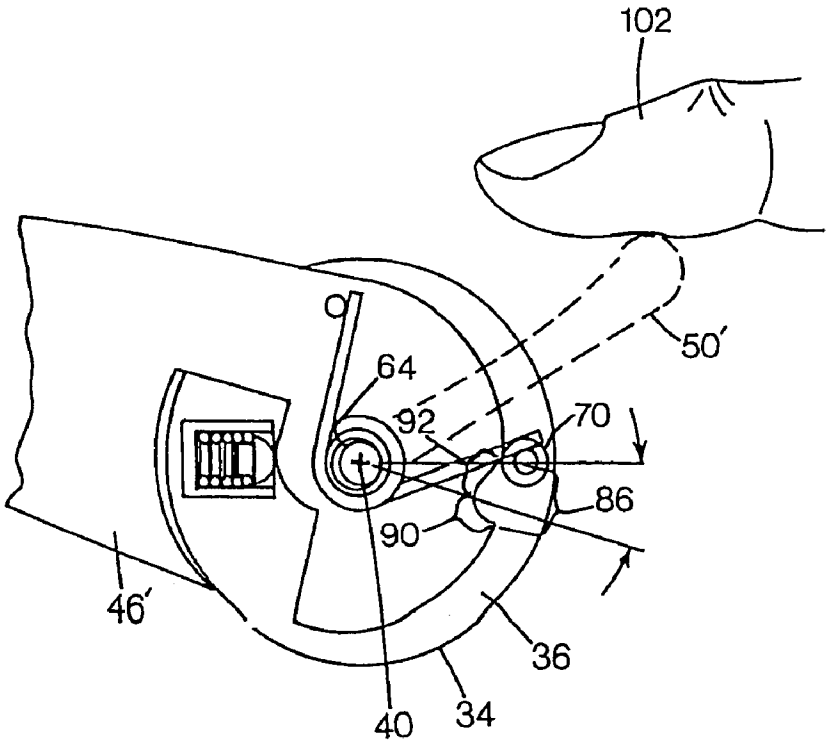
FIG. 4 is an enlarged schematic sectional view of the assembly of FIG. 1 in a second partially open position.
Figure 3:
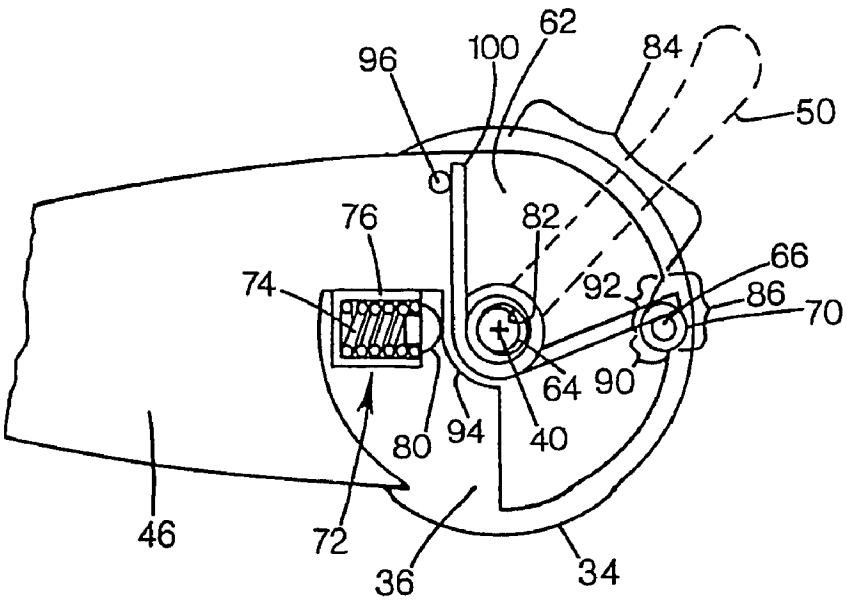
FIG. 3 is an enlarged schematic sectional view of the assembly of FIG. 1 in a first closed position.

FIGS. 3 and 4 show simplified views of the mechanisms that achieve the desired cap path. The face 36 of the frame boss is exposed, as the outer shell portion of the pivot arm is removed for illustrative purposes to expose an inner portion 62 of the hub, which forms a base portion of the arm 46. The frame includes a central pin 64 aligned with the frame axis 40, and a second cam pin 66 surrounded by a tubular roller 70 formed of nylon or other low friction material. The cam pin is spaced apart from the central pin in a direction toward the cable, away from the closed-position arm 46. A spring mechanism 72 is positioned adjacent to the central pin 64 on the opposite side as the cam pin 66. The mechanism includes a coil spring 74 contained in a pocket 76 having an opening facing the central pin 64. A bullet 80 formed of nylon or other low friction material is connected to the end of the spring, which biases the bullet toward the central pin.

The arm 46 defines a hub aperture 82 that receives the frame's central pin 64. The aperture 82 is significantly larger than the pin diameter, so that the arm has some free play in the lateral direction defined by the connector axis 26 (it also has free play in both axes that define the plane of the face 36.) The hub portion 62 has an arcuate perimeter portion that provides a first cam surface portion 84 centered on the hole 82. The perimeter also defines a notch or recess 86 in the cam surface at a position opposite the arm extension, in registration with the cam pin and roller 70 when the device is in the closed position. The notch has an arcuate portion 90 having the same radius as the roller 70, and a flat ramp portion 92 extending tangentially from the arcuate portion 90 to the first cam surface 84.

In the quadrant opposite the cam surface 84, the arm hub 62 has a bearing surface 94 at a short radius from the hole 82, providing a narrow curved wall that fits between the frame's central pin 64 and the bullet 80. The bullet bears on the bearing surface to bias the hub in the direction of the cam pin and roller 70. In the preferred embodiment, the hole 82 has a diameter of 0.225 inch, the central pin has a diameter of 0.125 inch, the roller has a diameter of 0.150 inch, the cam surface 84 has a radius of 0.75 inch, and the notch extends to a depth of 0.100 into the cam surface 84. The bullet spring has a force of one pound in the position indicated, and the torsion spring provides a torque in the range of 1.0 to 1.5 inch-pounds.

The arm further includes a spring support pin 96 near the forward limit of the cam surface 84, and a torsion spring 100 received on the central pin 64 has arms that bear outward against the pin 96 and the cam pin 66, to bias the arm into the closed position, and to resist opening of the arm, except under deliberate force.

In FIG. 3, the arm is in the closed position. The notch aligns with the roller, and the arm hub is biased rightward by the bullet 80. The cap is biased against the rim by the effect of the bullet spring 74, as long as the notch is aligned with the roller. The arm is biased to the closed position by the torsion spring 100, which maintains the alignment that allows the bullet spring to bias the gasket closed.

FIG. 4 shows the arm in the intermediate position. When the arm departs from the closed position, the force applied by the user's finger 102 causes the hub to rotate clockwise. The ramp 92 acts against the roller 70, pushing the hub toward the left, and compressing the bullet spring. The free play at the pivot pin and hole allow this lateral movement. During the time the roller is riding up the ramp, the cap is following the initial path portion 56 indicated in FIG. 2. When the hub has rotated enough so that the roller is transitioning to the cam surface 84, the cap is transitioning to the second path portion 58. After the roller reaches the cam surface, the lateral position of the hub is unchanged, and the bullet is retracted to accommodate the shifted hub position. The arm may then continue to the fully open position, as needed for connection of the cable terminal to an instrument or other element. When connected for operation, the arm will be kept from closing by the presence of an instrument or connected terminal. When the cable is disconnected, the arm will automatically close due to the force of the torsion spring, and when the notch reaches the roller, the bullet spring will bias the cap to a sealed condition. Accordingly, a user need not remember to take any action to ensure that the rim is sealed before immersing it in a sterilant.

While the above is discussed in terms of preferred and alternative embodiments, the invention is not intended to be so limited. For instance, while the notched cam is on the arm, and the roller serving as a cam follower is on the frame, these functions may be reversed. Moreover, other mechanisms may be employed to provide the different motion paths (one portion to facilitate decapping and recapping without excessive friction, the other portion to facilitate movement of the cap to a position rear of the rim plane.) The actuator need not be a pivoting lever, but may be a sliding sleeve or a linear actuator such as a button whose motion converts to the desired cap operation.

Figure 5:
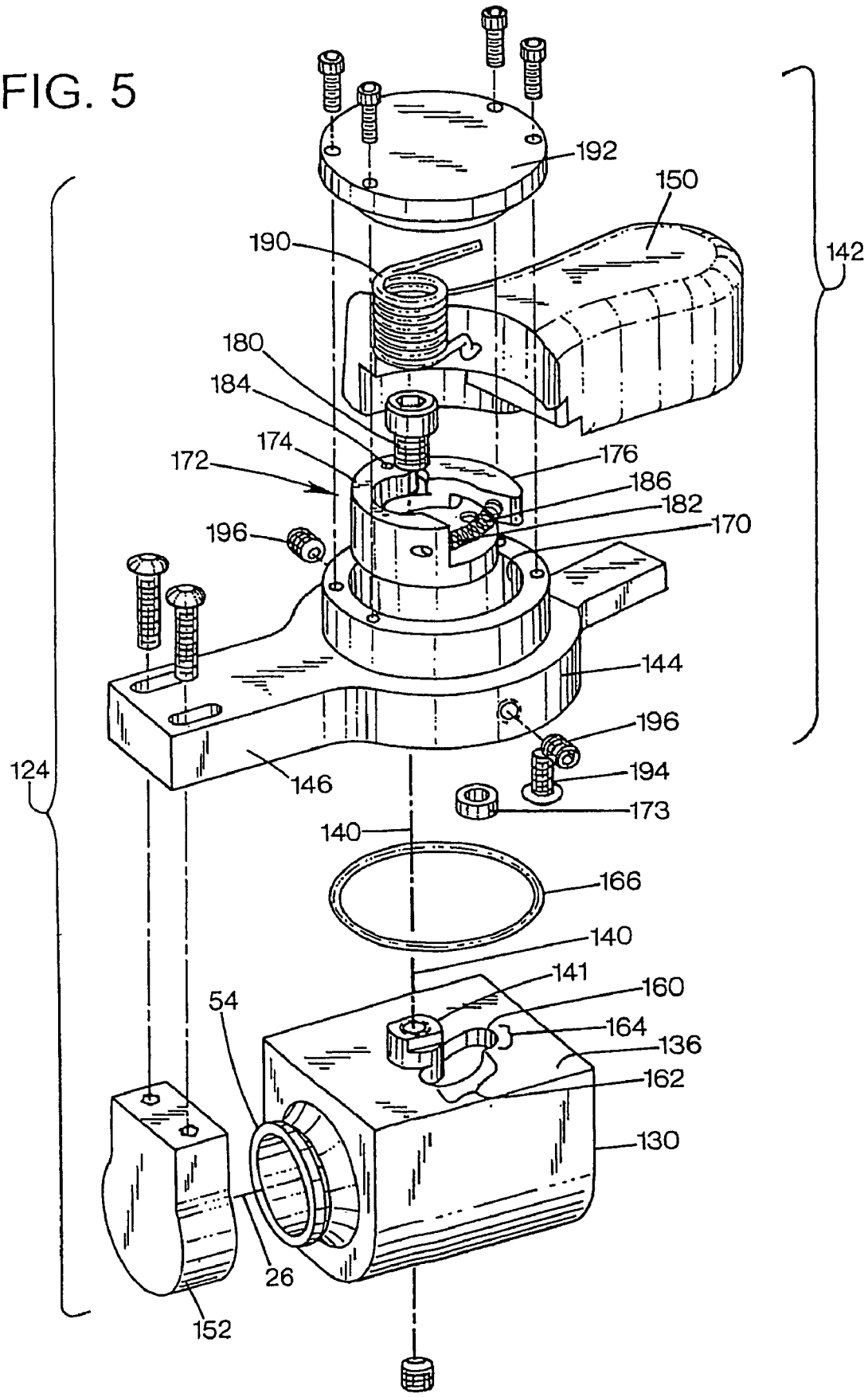
FIG. 5 is a perspective exploded view of an alternative embodiment of the invention.

FIG. 5 shows a detailed view of an alternative embodiment sealing mechanism 128, which may be similarly connected to the cable terminal body 14 (not shown in this figure). A frame 130 receives a cylindrical portion of the terminal body 14 to reveal the rim 22 (not shown). The frame has a flat, circular face 136. A pivot axis 140 and spindle 141 are central and perpendicular to the face 136, and intersect the terminal axis 26 at a right angle.

A pivot element 142 is pivotally connected to the frame for pivoting approximately on the spindle between a closed position and an open position. The pivot element includes a hub 144 centered on and overlaying the face 136, an arm 146 extending from the hub in a first direction toward the free end of the terminal, and a handle 150 connected to and extending from the hub in a second direction approximately opposite the first direction.

The arm 146 is terminated in a circular cap portion 152 having a diameter slightly larger than the terminal rim 22 (not shown), and overlaying the rim. The cap has a flexible elastomeric gasket on the cap surface facing the pivot axis as noted above.

The frame defines a cam channel or track 160 having a first portion 162 that is arcuately centered on the spindle 141, and a second portion 164 that deviates from the arcuate path away from the spindle in a direction away from the terminal rim 22 (not shown.) A face seal, skirt seal or O-ring 166 is received between the face 136 and the arm hub 144 to provide a seal against intrusion of sterilants.

The hub defines a major cylindrical pocket 170 generally centered on the axis 140 and receiving a compressible cam assembly 172, The pocket has a floor (not shown) with a central aperture. A cam roller 173 is connected to the lower surface of the hub, so that it can ride in the channel 160 as the arm pivots, causing the arm to shift laterally in the manner discussed below.

The cam assembly includes a bushing element 174 with a spring arm 176 pivotally connected to the bushing. The bushing element is secured by screw 180 to the spindle, with flats on the sides of the spindle mating with an oblong central hole 182 to prevent rotation of the bushing with respect to the frame 130. The floor of the arm hub is captured between the bushing and the face 136, so that the arm is free to rotate, and also to shift along axis 26 as will be needed for the function discussed below. Thus, the bushing is essentially part of the frame, except that it needs to be detachable for assembly.

The arm 176 pivots with respect to the bushing 174 at pivot axis 184, and has a generally cylindrical outer surface that bears against the interior surface of the sidewall of pocket 170, generally contacting the side of the pocket away from the connector rim 22 (not shown). A compression coil spring 186 is positioned between the respective end portions of the bushing and arm 176 to bias them apart. This causes both surfaces to bear outwardly against the hub pocket, as will further be discussed below.

A torsion spring 190 is received within the hub, in a space defined between the bushing and the spring arm 176. One leg of the spring 190 engages a notch on the lower portion of the spring arm (essentially engaging the fixed frame via the bushing) and the other engages the cap 192. This causes the handle and arm to resist pivoting robustly, and to return firmly to the closed position when released from an open position. A lid 192 is connected to the hub to enclose and seal the pocket 170, to secure the components therein, and to prevent entry of sterilants. Screw 194 attaches the handle 150 to the hub, and set screws 196 are adjustable to limit lateral movement of the hub in a direction perpendicular to axes 26 and 140.

Figure 6C:
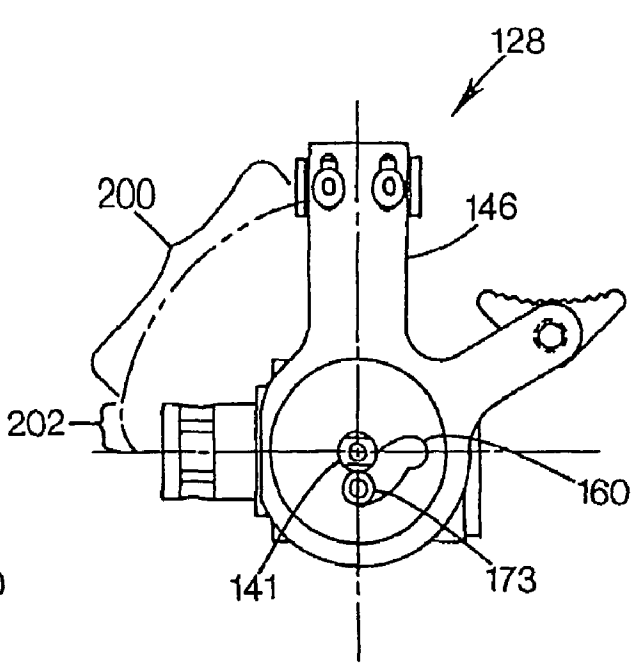
FIGS. 6A-C illustrate a sequence of operation of the embodiment of FIG. 5.
Figure 6B:
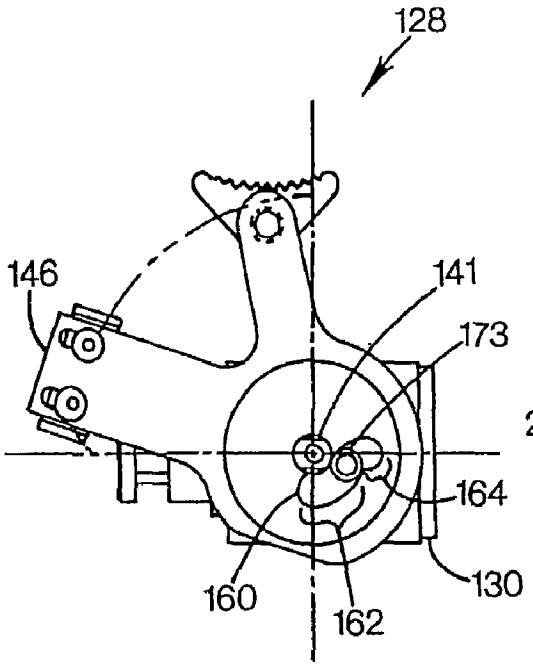
Figure 6A:
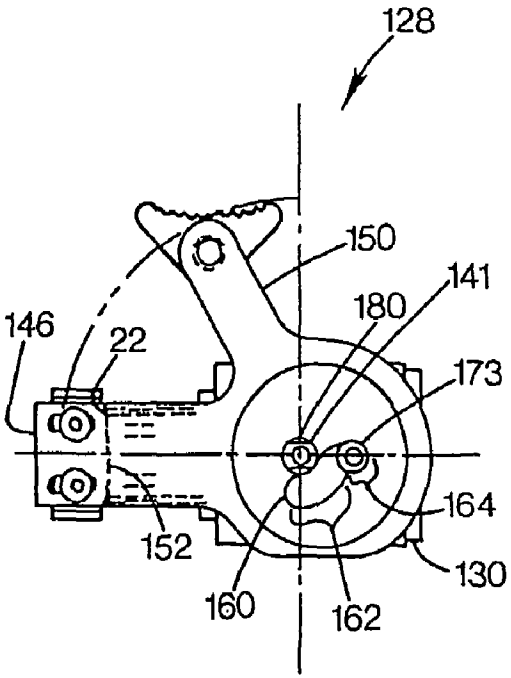

FIGS. 6A-C show a simplified cut away view of the mechanism 128 in operation. The arm 146 is shown with a handle 150 in a different position to illustrate an alternative handle embodiment, and the lid, bushing, spring arm and springs are removed. FIG. 6A shows the closed position, with the cap 152 sealed against the terminal rim 22. The frame 130 is indicated with the normally-hidden cam slot 160 visible. The roller 173 is indicated, without the pocket floor that normally supports it, and which would obscure the clarity of the view. The spindle 141 and screw 180 are indicated. Note that the arm 146 does not precisely pivot on the spindle, as this is simply the point at which the bushing connects to the frame. The channel 160 and spindle are fixed with reference to the frame, and the roller is fixed with reference to the arm. The cap 152 is mated with the rim 22, as the roller 173 attached to the arm is allowed to move rightward into the larger radius portion 164 of the channel 160.

In FIG. 6B, the mechanism 128 is in an intermediate position, with the cap having moved axially and angularly away from the rim. The arm's roller 173 forces the arm to move axially away from the rim as it pivots, because the roller rides the channel to a position at the start of the portion 162, closer to spindle 141. Note that the arm hub's vertical position is constrained by the bushing (not shown), and the hub has shifted to the left with respect to the frame 130 and its attached spindle 141.

In FIG. 6C, the arm is in the fully open position, with the arm's roller 173 now at the far end of the channel 160. Note that the roller has followed an arcuate path centered on the spindle in the transition between the intermediate and open positions. Accordingly, the arm's cap has followed an arcuate path 200 centered on the spindle from the intermediate position, as contrasted with the angled path 202 between the closed and intermediate positions.

Figure 7C:
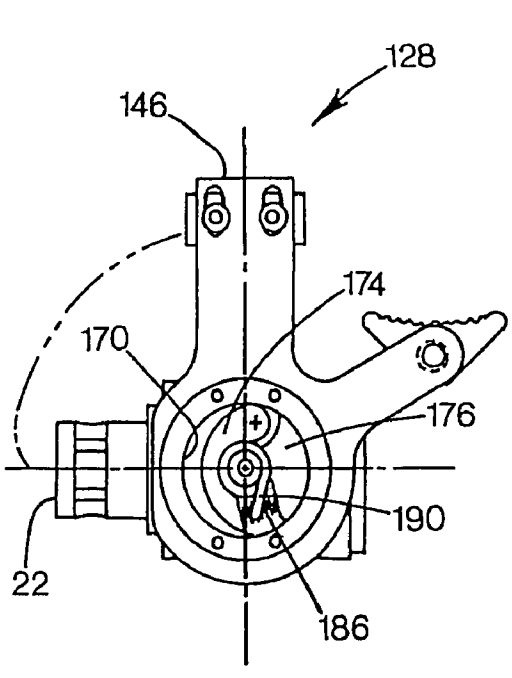
FIGS. 7A-C illustrate a sequence of operation of the embodiment of FIG. 5.
Figure 7B:
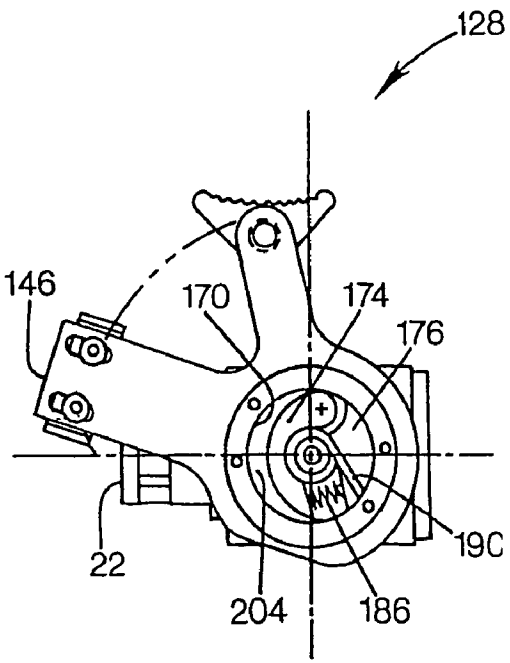
Figure 7A:
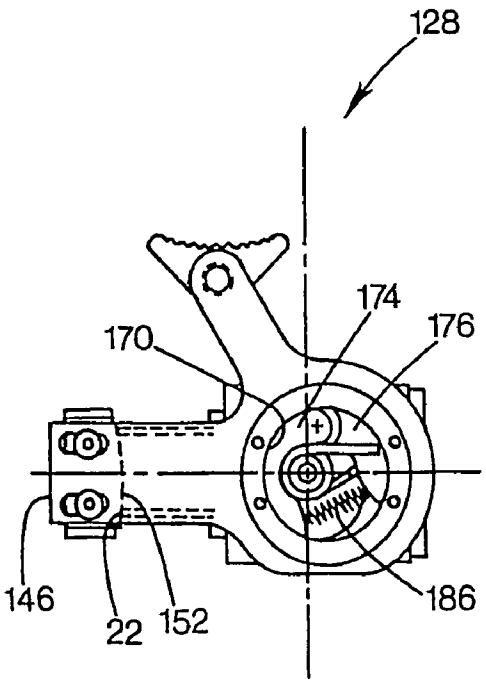

FIGS. 7A-C illustrate how the bushing 174 and spring arm 176 operate to provide biasing force to keep the cap sealed when in the closed position, and to constrain motion of the arm and hub without excessive constraint that would impair operation.

FIG. 7A shows the arm in a closed position. The hub pocket 170 receives the bushing 174 and spring arm 176. The coil spring 186 biases the arm away from the bushing. As the arm is shifted to the right to seal the rim, due to the position of the roller in the channel as noted above regarding FIG. 6A, the left wall of the pocket nearly contacts the surface of the bushing. The spring arm is extended away from the bushing to bias against the right wall of the pocket. Preferably, to ensure that the spring arm's biasing force translates into a biasing of the cap 152 against the rim, there is slight space allowed between the bushing and the pocket's left wall.

In FIG. 7B, the mechanism 128 has been partially opened to the intermediate position also shown in FIG. 6B. As the hub has shifted leftward due to the roller riding up the channel, the spring arm 176 has been forced leftward, compressing the spring 186. The leftward shift of the hub has generated a gap 204 between the bushing and the left wall of the pocket. These positions are maintained as the arm moves to the open position shown in FIG. 7C. Through the transition from open to closed, the torsion spring is increasingly displaced, biasing the arm to return to the closed position. As the arm closes, the steps are reversed, with the coil spring 186 biasing the cap toward and against the rim.

While the above is discussed in terms of preferred and alternative embodiments, the invention is not intended to be so limited.

The invention claimed is:

1. A cap facility for a medical cable having an elongated terminal body with a free end defining a rimmed chamber containing electrical contacts, the facility comprising:

a frame operable for connection to the terminal;

an arm pivotally connected to the frame at a pivot axis, the arm (a) movable between a first closed position and a second open position, (b) having a cap adapted to enclose the rimmed chamber when the arm is in the closed position, and (c) being biased to the closed position; and an unsealing mechanism operable in response to initial motion of the arm from the closed position to move the cap away from the rim on a path that deviates from an arc defined by the pivot axis.

2. The facility of claim 1 wherein the unsealing mechanism includes a cam surface on at least one of the arm and the frame, the cam surface having a selected portion having a first surface portion offset at an angle from an arcuate surface defined by the pivot axis.

3. The facility of claim 2 wherein the frame includes a contact element offset from the pivot axis, the arm includes an arcuate surface concentric with the pivot axis and operable to contact the contact element when the arm is pivoted, and the arcuate surface defines a recess sized to receive the contact element when the arm is in the closed position.

4. The facility of claim 3 wherein the cap follows a generally arcuate path defined by the pivot axis between the closed position and the open position, except that the cap follows an initial path portion adjacent to the closed position, the initial path portion deviating from the arcuate path such that the cap moves away from the rim when departing from the closed position.

5. A self-sealing medical cable assembly having a terminal defining a rimmed chamber containing electrical contacts comprising:

a frame operable for connection to the terminal;

an arm connected to the frame, the arm (a) being movable between a first closed position and a second open position (b) being biased to the closed position, and (c) having a cap adapted to enclose the rimmed chamber when the arm is in the closed position, the cap (i) having an arcuate motion path between the open position and an intermediate position proximate to the closed position, and (ii) having an initial motion path deviating from the arcuate path, such that the cap moves away from the rim initially upon departing from the closed position.

6. The cable assembly of claim 5 wherein the arm includes an actuator extending generally away from the cap at an obtuse angle.

7. The cable assembly of claim 5 including a cam surface on at least one of the arm and the frame, the cam surface having a selected portion having a first surface portion offset at an angle from an arcuate surface defined by the pivot axis.

8. The cable assembly of claim 5 wherein the arm is pivotally connected to the frame at a pivot axis defining the arcuate path.

9. The cable assembly of claim 8 wherein the terminal body defines a terminal axis, and the pivot axis intersects the terminal axis.

10. The cable assembly of claim 8 wherein the frame includes a contact element offset from the pivot axis, the arm includes an arcuate surface concentric with the pivot axis and operable to contact the contact element when the arm is pivoted, and wherein the arcuate surface defines a recess sized to receive the contact element when the arm is in the closed position.

11. The cable assembly of claim 8 wherein the pivotal connection of the arm to the frame includes free play enabling the arm to move a limited amount in a direction perpendicular to the pivot axis.

12. The cable assembly of claim 11 wherein the arm is biased to the frame in a direction perpendicular to the pivot axis, such that arm motion in a direction perpendicular to the pivot axis is limited except in response to an application of force.

* * * * *